US005368002A

United States Patent [19]

Hoshino et al.

[11] Patent Number: 5,368,002

[45] Date of Patent: Nov. 29, 1994

[54] APPARATUS FOR CONTROLLING A FLOW OF EVAPORATED FUEL FROM A CANISTER TO AN INTAKE PASSAGE OF AN ENGINE

[75] Inventors: Shinichi Hoshino; Koji Okawa, both of Toyota; Akinori Osanai, Susono; Takaaki Itou, Mishima; Yoshihiko Hyodo, Susono; Toru Kidokoro, Hadano, all of Japan

[73] Assignee: Toyota Jidosha Kabushiki Kaisha, Aichi, Japan

[21] Appl. No.: 84,704

[22] Filed: Jun. 25, 1993

[30] Foreign Application Priority Data

Jul. 1, 1992 [JP] Japan ..... 4-174523

[51] Int. Cl.[5] ..... F02M 37/04

[52] U.S. Cl. ..... 123/520; 123/198 D

[58] Field of Search ..... 123/520, 521, 518, 519, 123/516, 198 D

[56] References Cited

U.S. PATENT DOCUMENTS

| | | | |
|---|---|---|---|
| 3,913,545 | 10/1975 | Haase | 123/520 |
| 4,664,087 | 5/1987 | Hamborg | 123/520 |
| 4,748,959 | 6/1988 | Cook | 123/520 |
| 4,951,637 | 8/1990 | Cook | 123/520 |
| 4,977,881 | 12/1990 | Abe | 123/520 |
| 4,995,369 | 2/1991 | Cook | 123/520 |
| 5,027,780 | 7/1991 | Uranishi | 123/520 |
| 5,226,398 | 7/1993 | Cook | 123/520 |
| 5,263,460 | 11/1993 | Baxter | 123/520 |

FOREIGN PATENT DOCUMENTS

| | | | |
|---|---|---|---|
| 0185966 | 10/1983 | Japan | 123/520 |
| 61-19962 | 1/1986 | Japan . | |
| 4-72453 | 3/1992 | Japan . | |

*Primary Examiner*—Carl S. Miller
*Attorney, Agent, or Firm*—Oliff & Berridge

[57] ABSTRACT

An evaporated fuel purge control apparatus includes a purge control valve arranged in a purge passage between a canister and an intake passage of an engine, the purge control valve being switched on and off in accordance with a control factor, the control factor indicating a duty ratio of an on-time of the purge control valve within a duty cycle to a total duty-cycle time, a detecting part for detecting an operating condition under which the engine is operating, and a flow rate control part for setting a control factor for the purge control valve in accordance with the operating condition detected by the detecting part, the control factor set by the flow rate control part allowing a flow rate of evaporated fuel fed from the canister into the intake passage through the purge control valve to be maintained at a constant level when the operating condition of the engine changes.

9 Claims, 14 Drawing Sheets

APPARATUS FOR CONTROLLING A FLOW OF EVAPORATED FUEL FROM A CANISTER TO AN INTAKE PASSAGE OF AN ENGINE

BACKGROUND OF THE INVENTION (1) Field of the Invention

The present invention generally relates to an evaporated fuel purge control apparatus, and more particularly to an apparatus for controlling a flow of evaporated fuel being fed from a canister into an intake passage of an internal combustion engine through a purge control valve arranged in a purge passage between the canister and the intake passage.

(2) Description of the Related Art

In an internal combustion engine, an evaporated fuel purge control apparatus is provided. In this evaporated fuel purge control apparatus, evaporated fuel from a fuel tank is absorbed by an absorbent in a canister, and the fuel vapor is fed from the canister into an intake passage of the engine through a purge control valve arranged in a purge passage between the canister and the intake passage. The flow of evaporated fuel from the canister into the intake passage is controlled by the purge control valve in accordance with an operating condition of the engine.

Japanese Laid-Open Patent Publication No.61-19962 discloses an evaporated fuel purge control device in which a purge control valve is arranged in a passage between a canister and an intake passage of an engine. The purge control valve is switched on and off in accordance with a duty ratio of an on-time of the valve within a duty cycle to a total duty-cycle time. In the control device disclosed in the above mentioned publication, an intake air amount when the engine is operating is detected, and the duty ratio of the purge control valve is controlled so as to be proportional to the detected intake air amount, in order to prevent the air-fuel ratio from significantly deviating from a desired air-fuel ratio due to the purge fuel flow.

However, the evaporated fuel purge control apparatus has a flow resistance within the system, and there is a time difference between when the internal pressure of the canister changes in response to a purge flow rate change and when the internal pressure of the fuel tank changes in response to the purge flow rate change. If, for example, the purge flow rate changes to a greater value when almost no fuel vapor is stored in the canister, the internal pressure of the canister is lowered. A large amount of fuel vapor is then supplied from the fuel tank to the canister and such fuel vapor is absorbed in the canister. The fuel vapor stored in the canister is subsequently fed into the intake passage, so that the fuel mixture supplied to the engine will be rich.

Conversely, if the purge flow rate changes to a smaller value, a certain mount of fuel vapor returns from the canister back to the fuel tank, and the remaining fuel vapor in the canister is fed into the intake passage so that the fuel mixture supplied to the engine will be lean.

Therefore, the conventional device mentioned above has a problem in that the fuel vapor concentration becomes unstable due to the purge flow rate change, and it is likely that a turbulence of the air-fuel ratio will occur when the purge flow rate changes.

Japanese Laid-Open Patent Publication No.4-72453 discloses an evaporated fuel purge control device in which a solenoid valve is arranged in a purge passage between a canister and an intake passage of an engine. The solenoid valve is switched on and off by a control part in accordance with a duty ratio of an on-time of the valve within a duty cycle to a total duty-cycle time so as to obtain an appropriate level of the purge flow rate in accordance with an operating condition of the engine.

In the control device disclosed in the above mentioned publication, a purge control process to determine the duty ratio for controlling the switching operation of the solenoid valve is carried out by maintaining a purge ratio (=(purge flow rate)/(intake air amount)) at a constant level. This purge control process is called a purge ratio control process. The ratio of a purge fuel amount (supplied from the canister to the engine) to a total fuel mixture amount (supplied to the engine) is constant and thus calculable, and it is easy to determine the purge fuel amount from this ratio. An air-fuel ratio feedback control process is performed to control the air-fuel ratio by changing the purge fuel amount in accordance with the total fuel mixture amount, which prevents the air-fuel ratio from significantly deviating from a desired value.

However, when the canister containing an absorbent for absorbing fuel vapor supplied from a fuel tank is saturated with fuel vapor, and when the engine is operating under an idling condition, it is difficult for the above mentioned conventional device to obtain an adequate level of the purge flow rate. Also, when the engine is operating under the idling condition, the intake air amount is small. In addition, the on-time of the solenoid valve within a duty cycle is small at such a time, and the actual purge flow rate becomes unstable and deviates from the desired purge flow rate due to the flow resistance of the canister. And, it is likely that the air-fuel ratio will become turbulent when the canister is saturated with fuel vapor and the engine is operating under the idling condition.

SUMMARY OF THE INVENTION

Accordingly, it is a general object of the present invention to provide an improved evaporated fuel purge control apparatus in which the above described problems are eliminated.

Another, more specific object of the present invention is to provide an evaporated fuel purge control apparatus which controls the flow rate of evaporated fuel fed from a canister into an intake passage of an engine through a purge control valve at a constant flow rate when the engine operating condition changes, so that a fuel vapor concentration is stabilized, thus preventing the turbulence of the air-fuel ratio from occurring due to the purge fuel flow.

Still another object of the present invention is to provide an evaporated fuel purge control apparatus which controls the flow rate of evaporated fuel fed from a canister into an intake passage of an engine through a purge control valve at a constant flow rate when the canister is saturated with fuel vapor, so that the fuel vapor concentration is stabilized, thus preventing the turbulence of the air-fuel ratio from occurring due to the purge fuel flow.

The above mentioned objects of the present invention are achieved by an evaporated fuel purge control apparatus which includes a purge control valve arranged in a purge passage between a canister and an intake passage of an engine, the purge control valve being switched on and off in accordance with a control factor, the control factor indicating a duty ratio of an on-time of the purge control valve within a duty cycle to a total duty-cycle time, a detecting part for detecting an operating condition under which the engine is operating, and a flow rate control part for setting a control factor for the purge control valve in accordance with the operating condition detected by the detecting part, the control factor set by the flow rate control part allowing a flow rate of evaporated fuel from the canister into the intake passage through the purge control valve to be maintained at a constant level when the operating condition of the engine changes.

According to the present invention, it is possible to stabilize a change in the fuel vapor concentration due to the purge fuel flow, thus preventing the turbulence of the air-fuel ratio from occurring when the engine operating condition changes or when the canister is saturated with fuel vapor.

Other objects and further features of the present invention will be apparent from the following detailed description when read in conjunction with the accompanying drawings.

DESCRIPTION OF THE PREFERRED EMBODIMENTS

Figure 1:
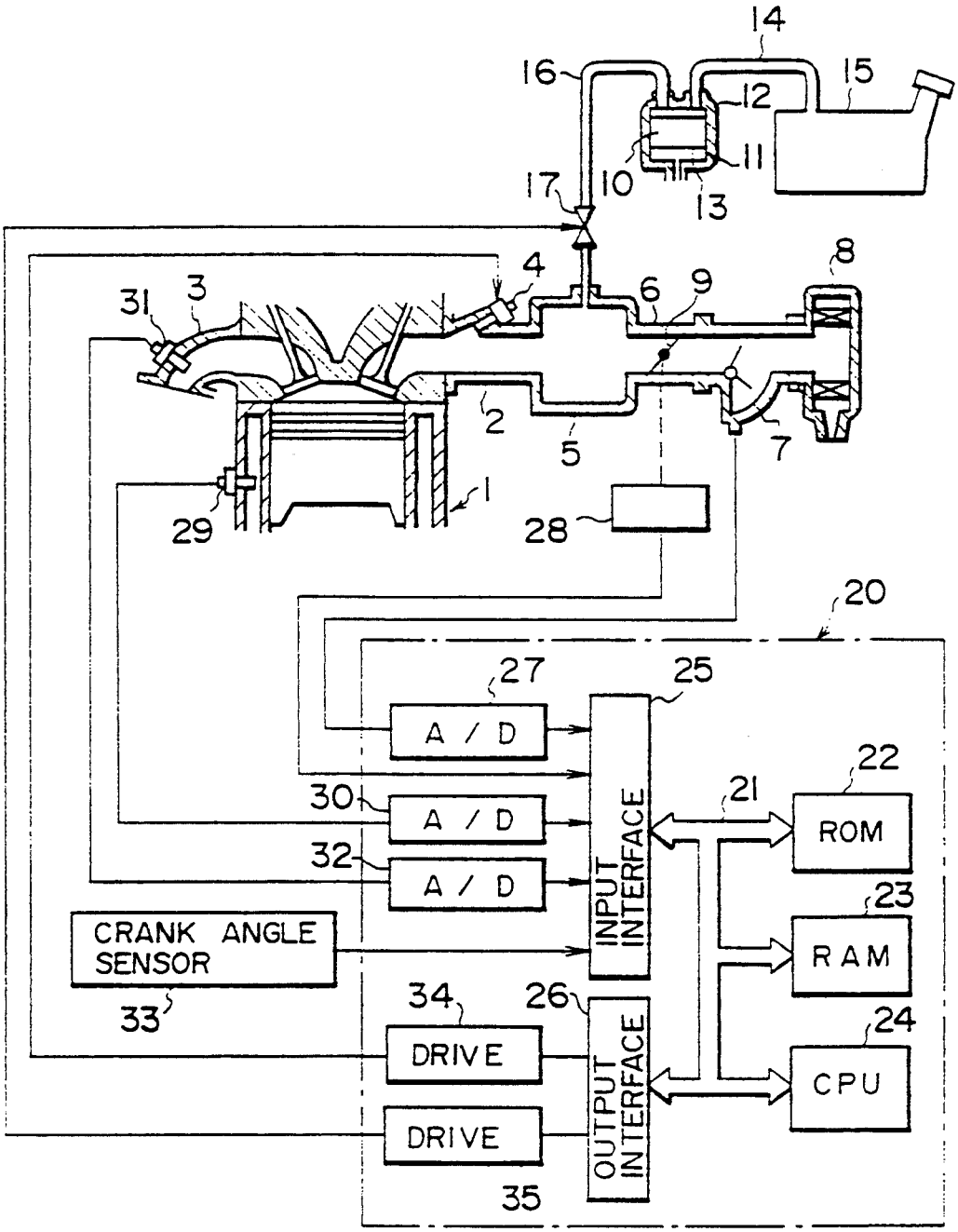
FIG. 1 is a system diagram showing an internal combustion engine in which an evaporated fuel purge control apparatus is provided.

A description will now be given of an internal combustion engine in which an evaporated fuel purge control apparatus is provided. FIG. 1 shows an internal combustion engine 1 which has four cylinders: only one cylinder of the engine is shown in FIG. 1, the other cylinders being omitted for the sake of convenience.

In the internal combustion engine 1 shown in FIG. 1, an intake pipe 2 is connected to an inlet port of each of the cylinders. An exhaust manifold 3 is provided at outlet ports of the cylinders of the engine. A fuel injection valve 4 for injecting fuel to the engine 1 is provided in the intake pipe 2.

The intake pipe 2 is connected to a surge tank 5, and the surge tank 5 is connected to an air cleaner 8 via an intake duct 6. An air flow meter 7 is provided at an intermediate portion between the surge tank 5 and the air cleaner 8 to sense the intake air amount. A throttle valve 9 for controlling the flow of intake air into the inlet ports of the engine is provided within the intake duct 6.

As shown in FIG. 1, a canister 11 containing active carbon 10 for absorbing evaporated fuel from a fuel tank 15 is provided. The canister 11 has a fuel vapor chamber 12 located above the active carbon 10 and an air chamber 13 located below the active carbon 10. The air chamber 13 is open to the atmosphere via an air inlet opening at the bottom of the canister 11. The fuel vapor chamber 12 of the canister 11 communicates with the fuel tank 15 via a vapor passage 14. The fuel vapor chamber 12 communicates with the surge tank 5 via a purge passage 16. A purge control valve 17 is provided at an intermediate portion of the purge passage 16 for controlling the flow of evaporated fuel being fed from the canister 11 to the intake passage of the engine. The purge control valve 17 is a vacuum switching valve (VSV) which can be switched on (or opened) and switched off (or closed) by inputting a signal to the VSV 17 by means of a control unit of the engine 1 (which will be described below).

The internal combustion engine 1 shown in FIG. 1 is provided with an electronic control unit (ECU) 20. The switching operation of the VSV 17 is controlled by inputting a signal to the VSV 17 by means of the ECU 20. Evaporated fuel in the fuel tank 15 is supplied to the canister 10 via the vapor passage 14, and the evaporated fuel is absorbed by the active carbon 10 of the canister 11. When the VSV 17 is switched on (or opened) by the output signal of the ECU 20 during engine operation, external air is fed from the air inlet opening of the canister 11 to the purge passage 16 due to a negative pressure occurring in the intake passage of the engine. When the external air passes through the active carbon 10 of the canister 11, the evaporated fuel is desorbed from the active carbon 10, and the fuel vapor is fed from the canister 11 into the surge tank 5 (or the intake passage of the engine) via the purge passage 16.

The electronic control unit (ECU) 20 shown in FIG. 1 is made up of a digital computer. The ECU 20 has a read only memory (ROM) 22, a random access memory (RAM) 23, a central processing unit (CPU) or microprocessor 24, an input interface circuit 25, and an output interface circuit 26. These components of the ECU 20 are interconnected by a bi-directional bus 21.

The air flow meter 7 outputs a signal indicating the intake air amount measured by the air flow meter 7, and this signal is supplied to the input interface circuit 25 via an analog-to-digital converter (A/D converter) 27. The A/D converter 27 converts the signal supplied from the air flow meter 7 into a digital signal, and the digital signal is supplied to the input interface circuit 25. A throttle switch 28 is connected to the throttle valve 9. When the throttle valve 9 is positioned at an idling position, the throttle switch 28 is turned ON and a digital signal is supplied from the throttle switch 28 to the input interface circuit 25. A water temperature sensor 29 is provided in the cylinder block of the engine 1, and the water temperature sensor 29 outputs a signal indicating the engine cooling water temperature to the input interface circuit 25 via an A/D converter 30. An oxygen sensor 31 is provided in the exhaust manifold 3 of the engine 1, and the oxygen sensor 31 outputs a signal indicating the concentration of oxygen gas in the exhaust gas, to the input interface circuit 25 via an A/D converter 32. The operation of each of the A/D converters 30 and 32 is the same as that of the A/D converter 27. A crank angle sensor 33 is connected to the input interface circuit 25, and the crank angle sensor 33 outputs a pulse signal to the input interface circuit 25 each time a crankshaft of the engine is rotated by 30 degrees. In the CPU 24, an engine speed (indicated as revolutions per minute) is calculated based on the signal supplied from the crank angle sensor 33.

Two driving circuits 34 and 35 are connected to the output interface circuit 26 of the ECU 20. Control signals supplied from the CPU 24 via the output interface circuit 26 are output from the driving circuits 34 and 35 to the fuel injection valve 4 and the purge control valve 17, respectively.

In the internal combustion engine 1 shown in FIG. 1, a fuel injection time TAU indicating a time that fuel supplied from the fuel tank 15 is injected by the fuel injection valve 4 to the engine 1 is determined in accordance with the following equation:

$$TAU = TP\,K\,[1+(FAF-1)+(FLRN-1)+FPG],$$

where TP is a basic fuel injection time, K is a fuel increase coefficient, FAF is a feedback correction factor, FLRN is an air-fuel ratio learning factor, and FPG is a purge correction factor. The CPU 24 of the ECU 20 carries out an air-fuel ratio feedback control process in which the fuel injection time TAU is calculated. The ECU 20 outputs a signal in accordance with the calculated fuel injection time TAU to the fuel injection valve 4 via the driving circuit 34. During the feedback control process, if it is judged (from the oxygen concentration of exhaust gas sensed by the oxygen sensor 31) that the air-fuel mixture is rich, the fuel injection time TAU is adjusted to a shorter time. If it is judged that the air-fuel mixture is lean, the fuel injection time TAU is adjusted to a longer time.

The basic fuel injection time TP is a fuel injection time value derived from experimental results and used to set the air-fuel ratio to be a target air-fuel ratio (or a theoretical air-fuel ratio). The basic fuel injection time TP is a function of the engine load Q/N (where Q is the intake air amount and N is the engine speed) and the engine speed N, and it is stored in the ROM 22. The feedback correction factor FAF is a correction factor used to adjust the air-fuel ratio in accordance with the output signal of the oxygen sensor 31 so that the air-fuel ratio is maintained at the theoretical air-fuel ratio. The purge correction factor FPG is a correction factor used to adjust the fuel injection amount of the fuel injection valve 4 after the fuel vapor is fed into the intake passage via the VSV 17. The purge correction factor FPG is calculated in accordance with the equation: $FPG = -(FPGA \times PRG)$, where FPGA is a fuel vapor concentration factor and PRG is a purge ratio.

Next, a description will be given of a purge control process performed by a control unit of the evaporated fuel purge control apparatus shown in FIG. 1 so as to control the flow of evaporated fuel from the canister into the intake passage. FIGS. 3A through 3D show the purge control process performed by the ECU 20 in FIG. 1. This purge control process is repeatedly performed every 1 millisecond (ms).

Figure 3A:
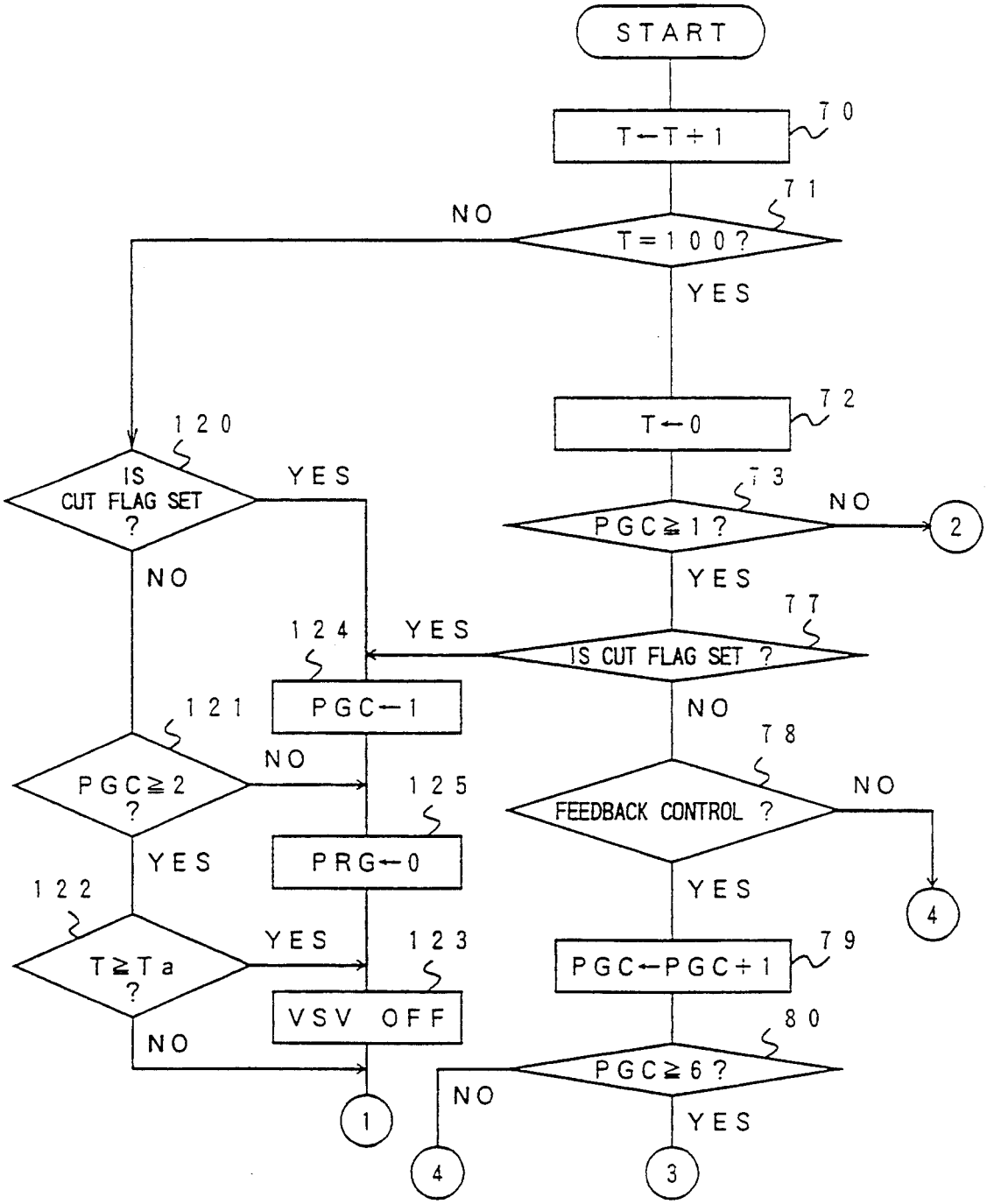
FIGS. 3A through 3D are a flowchart for explaining a purge control process performed by the evaporated fuel purge control apparatus shown in FIG. 2.

In the purge control process shown in FIG. 3A, step 70 increments a timer count T ($T \rightarrow T+1$). Step 71 detects whether or not the value of the timer count T is equal to 100. A total duty-cycle time for switching on or off the purge control valve 17 is equal to 100 milliseconds (ms), and step 71 detects whether or not the timer count T is equal to the total duty-cycle time of the purge control valve 17. If the answer to step 71 is affirmative, steps 72 through 80 are performed. In other words, steps 72 through 80 are performed every 100 milliseconds. In step 72, the timer count T is reset to zero. Step 73 detects whether or not a purge count PGC is equal to of greater than 1. If the answer to step 73 is negative (or the purge count PGC is equal to zero), it is judged that step 73 has been performed after an ignition switch (not shown) is turned on. Then, steps 74–76 shown in FIG. 3B are performed.

Figure 3B:
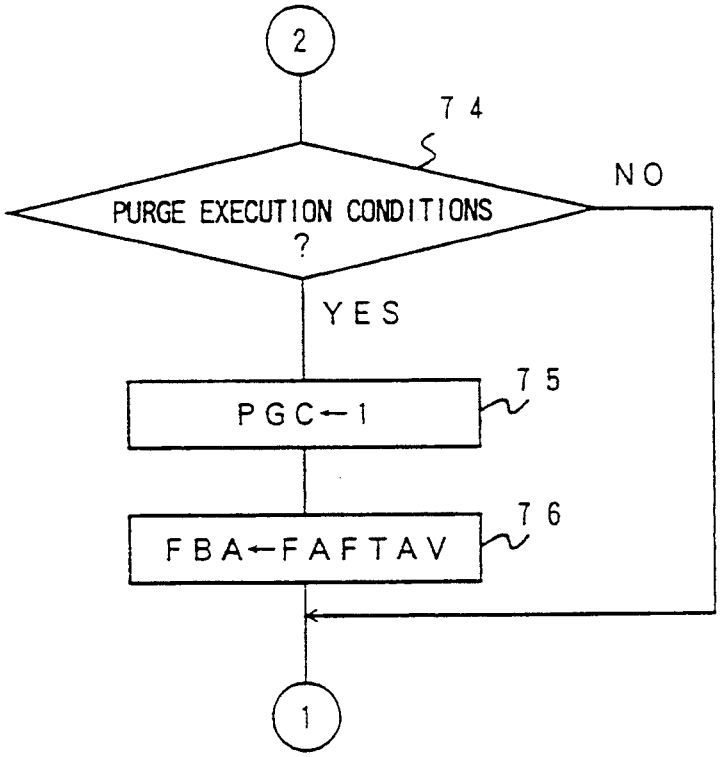

In step 74 shown in FIG. 3B, it is detected whether or not the purge execution conditions are satisfied. The purge execution conditions are those conditions required to start the feeding of evaporated fuel from the canister into the intake passage via the VSV 17. The purge execution conditions include: (1) the engine cooling water temperature sensed by the water temperature sensor 29 is higher than 70 deg. C; (2) that an air-fuel ratio feedback control process to determine an air-fuel ratio is being performed; and (3) the number of skip steps performed to determine the feedback correction factor FAF is equal to or greater than 5. If the answer to step 74 is negative, the purge control process ends. If the answer to step 74 is affirmative, step 75 sets the purge count PGC to 1 ($PGC \rightarrow 1$). Step 76 sets a factor FBA to the value of a feedback correction factor total average FAFTAV ($FBA \rightarrow FAFTAV$). The value of the factor FBA at this time indicates the average of a total feedback correction factor FAFT when the purge execution conditions are satisfied. After step 76 is performed, the purge control process ends.

Figure 3C:
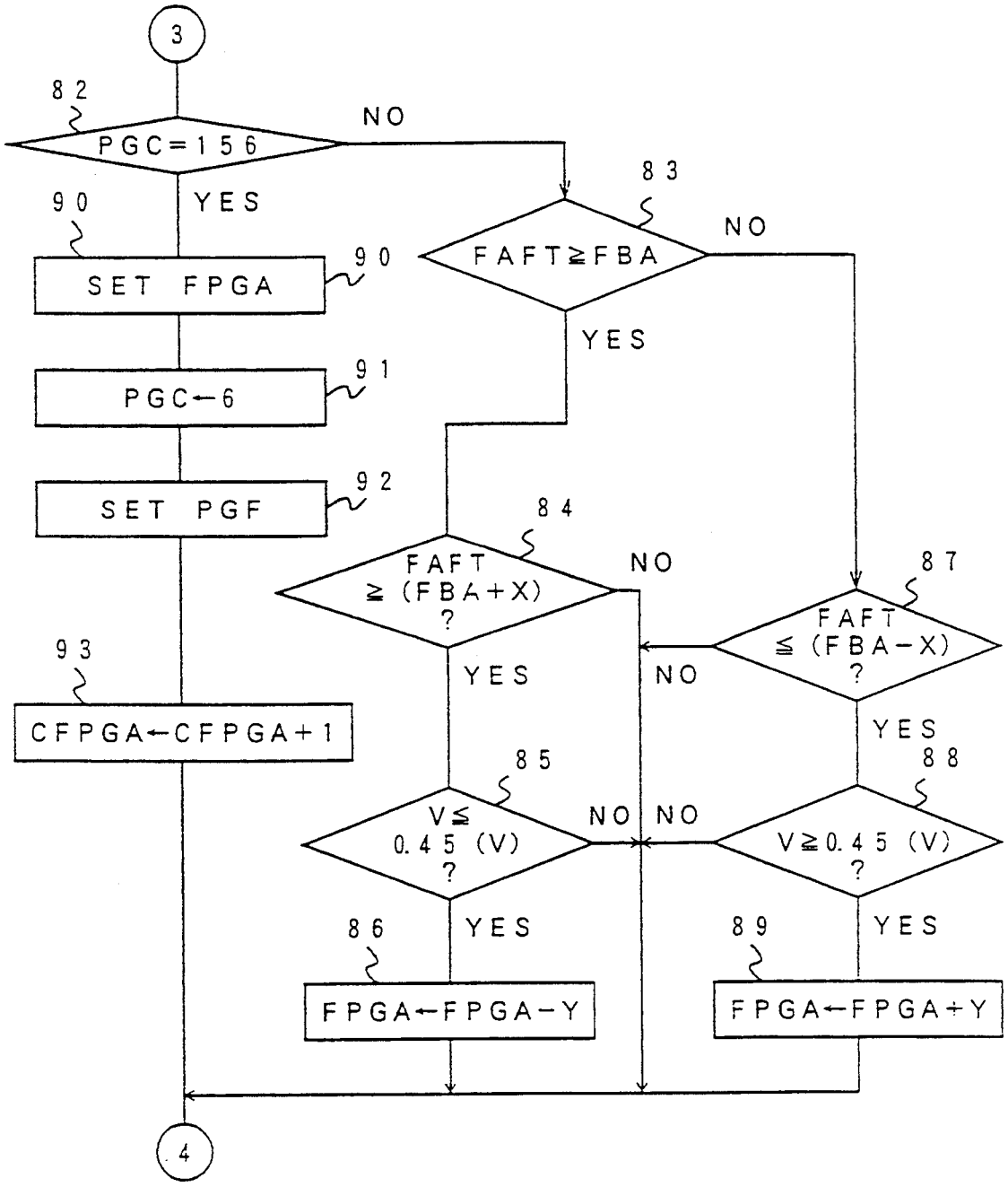
Figure 3D:
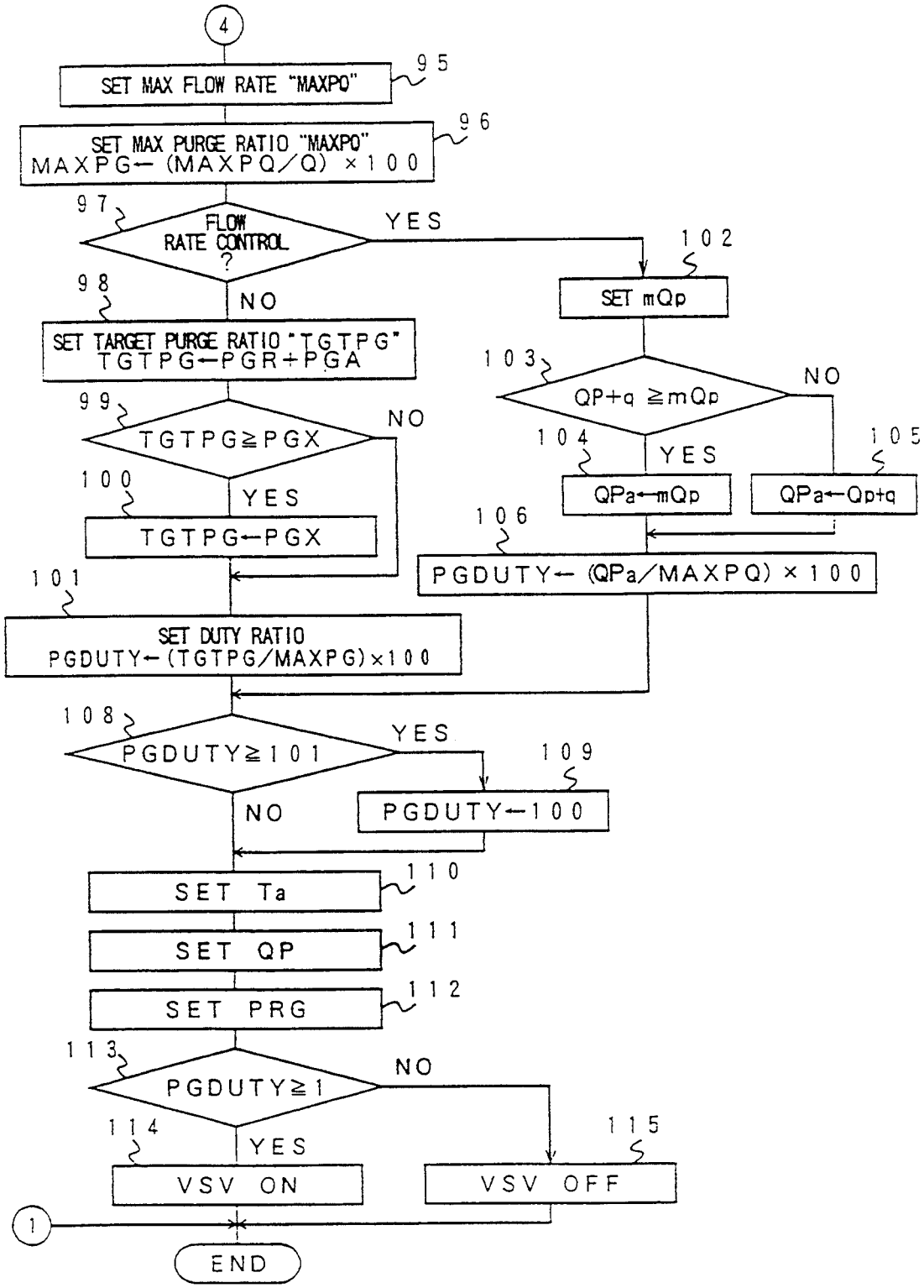

After it is detected in step 74 that all the purge execution conditions are satisfied, the answer to step 73 shown in FIG. 3A is affirmative (or $PGC \geqq 1$), and step 77 is performed. Step 77 detects whether or not a cut flag is equal to 1. When the cut flag is set to 1, the fuel injection performed by the fuel injection valve 4 is stopped. When the cut flag is reset to 0, the fuel injection is performed by the fuel injection valve 4. If the answer to step 77 is negative, step 78 detects whether or not the air-fuel ratio feedback control process is being performed. If the answer to step 78 is affirmative, step 79 increments the purge count PGC ($PGC \rightarrow PGC+1$). After step 79 is performed, step 80 detects whether or not the purge count PGC is equal to or greater than 6. If the answer to step 80 is affirmative (500 ms having elapsed since the purge execution conditions were satisfied), step 82 shown in FIG. 3C is performed. If the answer to step 80 is negative, step 95 shown in FIG. 3D is performed.

In steps 82 through 93 shown in FIG. 3C, the fuel vapor concentration of the air-fuel mixture being supplied to the engine is calculated. Step 82 detects whether or not the purge count PGC is equal to 156. Initially after step 80 shown in FIG. 3A is performed, the answer to step 82 is negative, and then step 83 is performed. Step 83 detects whether or not the total feedback correction factor FAFT is equal to or greater than the factor FBA. If the answer to step 83 is affirmative (FAFT≧FBA), step 84 is performed. If the answer to step 83 is negative, step 87 is performed.

Step 84 detects whether or not the total feedback correction factor FAFT is equal to or greater than the upper limit (FBA+X). The value of the factor FBA indicates the average of the total feedback correction factor FAFT when the purge execution conditions are satisfied, and X is a given constant having a small value. If the answer to step 84 is negative (FAFT<(FBA+X)), step 95 shown in FIG. 3D is performed.

Step 87 detects whether or not the total feedback correction factor FAFT is equal to or smaller than the lower limit (FBA−X). If the answer to step 87 is negative (or FAFT>(FBA−X)), step 95 shown in FIG. 3D is performed. If the answer to step 87 is affirmative (or FAFT≦(FBA−X)), step 88 is performed. Step 88 detects whether or not the voltage V output from the oxygen sensor 31 is equal to or higher than 0.45 volts. If the voltage V≧0.45 volts, it is judged that the air-fuel mixture rich, and then step 89 is performed. If the voltage V<0.45 volts, it is judged that the air-fuel mixture is lean, and then step 95 shown in FIG. 3D is performed.

Step 89 adds a given value Y to a fuel vapor concentration factor FPGA (FPGA→(FPGA+Y)). After step 89 is performed, step 95 is performed. Therefore, when both of the respective answers to steps 87 and 88 are affirmative (FAFT≧(FBA−X) and V≧0.45 volts), the fuel vapor concentration factor FPGA is increased by the given value Y. It is possible to prevent the turbulence of the air-fuel ratio from occurring after the FAFT is lower than the lower limit (FBA−X).

If the answer to step 84 is affirmative (FAFT≧(FBA+X)), step 85 is performed. Step 85 detects whether or not the voltage V output from the oxygen sensor 31 is equal to or lower than 0.45 volts (V). If V≦0.45 volts, it is judged that the air-fuel mixture is lean, and then step 86 is performed. Step 86 subtracts the given value Y from the fuel vapor concentration factor FPGA (FPGA→(FPGA−Y)). After step 86 is performed, step 95 is performed. Conversely, if V>0.45 volts, it is judged that the air-fuel mixture is rich, and then step 95 is performed. Therefore, when both the answers to steps 84 and 85 are affirmative (FAFT≧(FBA+X) and V≦0.45 volts), the fuel vapor concentration factor FPGA is decreased by the given value Y. It is possible to prevent the turbulence of the air-fuel ratio from occurring after the FAFT is higher than the upper limit (FBA+X).

If the answer to step 82 shown in FIG. 3C is affirmative, 15.6 seconds have elapsed since the above step 82 was first performed, and then step 90 is performed. Step 90 calculates the fuel vapor concentration factor FPGA at present in accordance with the following equation:

$$FPGA = FPGA - (FAFTAV - FBA)/(PRG \times 2)$$

where PRG is the purge ratio.

In step 90, the fuel vapor concentration of the air-fuel mixture fed into the intake passage is determined by subtracting half of a change in the feedback correction factor FAF per unit purge ratio from the fuel vapor concentration factor FPGA. When the FAFTAV is smaller than the FBA, the FPGA is increased in step 90. When the FAFTAV is greater than the FBA, the FPGA is decreased in step 90.

After step 90 is performed, step 91 sets the purge count PGC to 6. Thus, the above step 90 is performed every 15.6 seconds. Step 92 sets a fuel vapor concentration setting flag PGF to 1, and this fuel vapor concentration setting flag PGF indicates whether the fuel vapor concentration has been currently calculated. After step 92 is performed, step 93 increments a fuel vapor concentration setting count CFPGA (CFPGA→CFPGA+1). Then, step 95 is performed.

Figure 4:
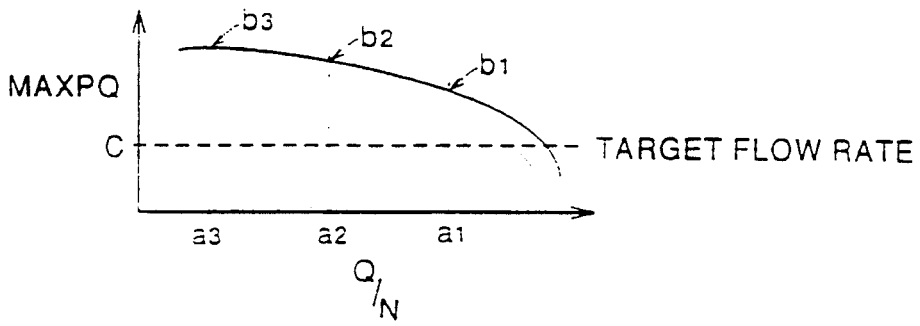
FIG. 4 is a chart showing a relationship between a maximum flow rate and an engine load, the relationship being used in the purge control process.

Step 95 shown in FIG. 3D sets a maximum flow rate MAXPQ from the engine load Q/N (the intake air amount per unit engine speed) by retrieving a map stored in the ROM 22, the map indicating a relationship between the maximum flow rate MAXPQ and the engine load Q/N. FIG. 4 shows the relationship between the maximum flow rate MAXPQ and the engine load Q/N, the relationship being indicated by the map stored in the ROM 22. Each value of the maximum flow rate MAXPQ in the stored map is predetermined by the flow rate at the fully-open purge control valve (VSV) 17 when the engine 1 is operating at the engine load Q/N.

After step 95 is performed, step 96 sets a maximum purge ratio MAXPG from the maximum flow rate MAXPQ and the intake air amount Q in accordance with the equation: MAXPG=(MAXPQ/Q)×100. The maximum purge ratio MAXPG is the ratio of the maximum flow rate MAXPQ to the intake air amount Q.

After step 96 is performed, step 97 detects whether or not flow rate control execution conditions are satisfied. The flow rate control execution conditions include: (1) CFPGA≧10 (the engine is operating under a steady condition in which the air-fuel ratio change correctly reflects the fuel vapor concentration); and (2) FPGA≦1.2 (the purge correction factor is low enough to prevent an excessive change in the air-fuel ratio or the turbulence of the air-fuel ratio from being produced).

If the answer to step 97 is negative, the flow rate control execution conditions are not satisfied, and then a purge ratio control procedure (steps 98–101) is performed. Step 98 sets a target purge ratio TGTPG by adding a given purge ratio PGA (e.g., PGA=0.2%) to the purge ratio PRG (TGTPG→PGR+PGA). Thus, the target purge ratio TGTPG is increased by the purge ratio PGA every 100 ms. Step 99 detects whether or not the target purge ratio TGTPG is greater than or equal to a predetermined maximum target purge ratio PGX (e.g., PGX=4%). If the answer to step 99 is affirmative, step 100 sets the target purge ratio TGTPG to the maximum target purge ratio PGX (TGTPG→PGX). If the answer to step 99 is negative, step 101 is performed (step 100 is not performed). Then, step 101 sets a driving duty ratio PGDUTY in accordance with the equation: PGDUTY=(TGTPG/MAXPG)×100. The VSV 17 is switched on and off in accordance with the driving duty ratio PGDUTY, the driving duty ratio PGDUTY indicating a duty ratio of an on-time of the VSV 17 within a duty cycle to a total duty-cycle time.

Figure 5:
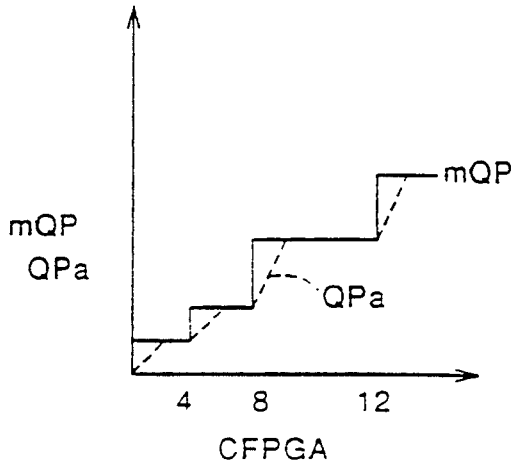
FIG. 5 is a chart showing a relationship between a target flow rate and a fuel vapor concentration setting count, the relationship being used in the purge control process.

If the answer to step 97 is affirmative, the flow rate control execution conditions are satisfied, and then a flow rate control procedure (steps 102–106) is performed. Step 102 sets a target flow rate mQP from the fuel vapor concentration setting count CFPGA by retrieving a map stored in the ROM 22. FIG. 5 shows the relationship between the target flow rate mQP and the fuel vapor concentration setting count CFPGA, the relationship being indicated by the map stored in the ROM 22. Each value of the target flow rate mQP in the stored map is predetermined as indicated by solid lines in FIG. 5, such that the target flow rate mQP is increased stepwise in accordance with the increase of the fuel vapor concentration setting count CFPGA to obtain an adequate amount of fuel vapor fed from the canister into the intake passage. The purge correction to the air-fuel ratio will be stabilized when the fuel vapor concentration setting count CFPGA is increased.

After step 102 is performed, step 103 detects whether or not the current purge flow rate QP to which a given increment q is added (QP+q) is greater than or equal to the target flow rate mQ. If the answer to step 103 is affirmative, step 104 sets a target purge flow rate QPa to the target flow rate mQP, or QPa=mQP. If the answer to step 103 is negative, step 105 sets the target purge flow rate QPa to the incremented purge flow rate (QP+q), or QPa=(QP+q). Accordingly, the change in the target purge flow rate QPa when the target flow rate mQP changes falls within the given increment q, thus preventing the target purge flow rate QPa from rapidly changing as indicated by a dotted line in FIG. 5. Then, step 106 sets the driving duty ratio PGDUTY from the maximum flow rate MAXPQ and the target purge flow rate QPa in accordance with the equation: PGDUTY=(QPa/MAXPQ)×100. As described above, the VSV 17 is switched on and off in accordance with the driving duty ratio PGDUTY, the driving duty ratio PGDUTY indicating a duty ratio of an on-time of the VSV 17 within a duty cycle to a total duty-cycle time.

After step 101 or 106 is performed, step 108 detects whether or not the driving duty ratio PGDUTY is greater than or equal to 101 (%). If the answer to step 108 is affirmative (PGDUTY≧101), step 109 sets the driving duty ratio PGDUTY to 100 (%). If the answer to step 108 is negative (PGDUTY<101), step 110 is performed (step 109 is not performed).

Step 110 sets a timer count Ta to the driving duty ratio PGDUTY, the timer count Ta being used when the VSV 17 is switched off. Step 111 sets the actual purge flow rate QP in accordance with the equation: QP=(PGDUTY×MAXPQ)/100. Step 112 sets the actual purge ratio PRG in accordance with the equation: PRG=(MAXPQ×PGDUTY)/100.

After step 112 is performed, step 113 detects whether or not the driving duty ratio PGDUTY is greater than or equal to 1. If the answer to step 113 is negative (PGDUTY<1), step 114 switches off the VSV 17. If the answer to step 113 is affirmative (PGDUTY≧1), step 115 switches on the VSV 17 in accordance with the driving duty ratio PGDUTY. Then, the purge control process ends.

If the answer to step 71 shown in FIG. 3A is negative (the timer count T not being equal to 100), step 120 is performed. Step 120 detects whether or not the cut flag is set to 1. When the cut flag is not equal to 1, step 121 detects whether or not the purge count PGC is greater than or equal to 2. When PGC≧2, step 122 detects whether or not the timer count T is greater than or equal to the timer count Ta. When T<Ta, the purge control process ends. When T≧Ta, step 123 switches off the VSV 17, and then the purge control process ends. Accordingly, when 100 ms have elapsed (or PGC≧2) since the purge execution started, the VSV 17 is first switched on so that feeding of evaporated fuel into the intake passage starts.

If the answer to step 120 or step 77 is affirmative (the cut flag being set to 1), step 124 is performed. Step 124 sets the purge count PG to 1. After step 124 is performed, step 125 resets the purge ratio PRG to zero. Then, the VSV 17 is switched off in step 123. If the answer to step 121 is negative (PGC<2), the above step 125 is performed to reset the purge ratio PRG to zero. Then, the VSV 17 is switched off in step 123. Accordingly, when the cut flag is set to 1, the purge execution is stopped, and the purge execution will re-start when the purge count PGC≧2.

When the ignition switch is turned on, an initialization process is performed before the execution of the purge control process shown in FIGS. 3A–3D is started. The purge count PGC, the timer count T, the driving duty ratio PGDUTY, the purge ratio PRG, the fuel vapor concentration factor FPGA, the fuel vapor concentration setting count CFPGA, etc. are reset to zero in the initialization process before the purge control process is first performed.

Figure 2:
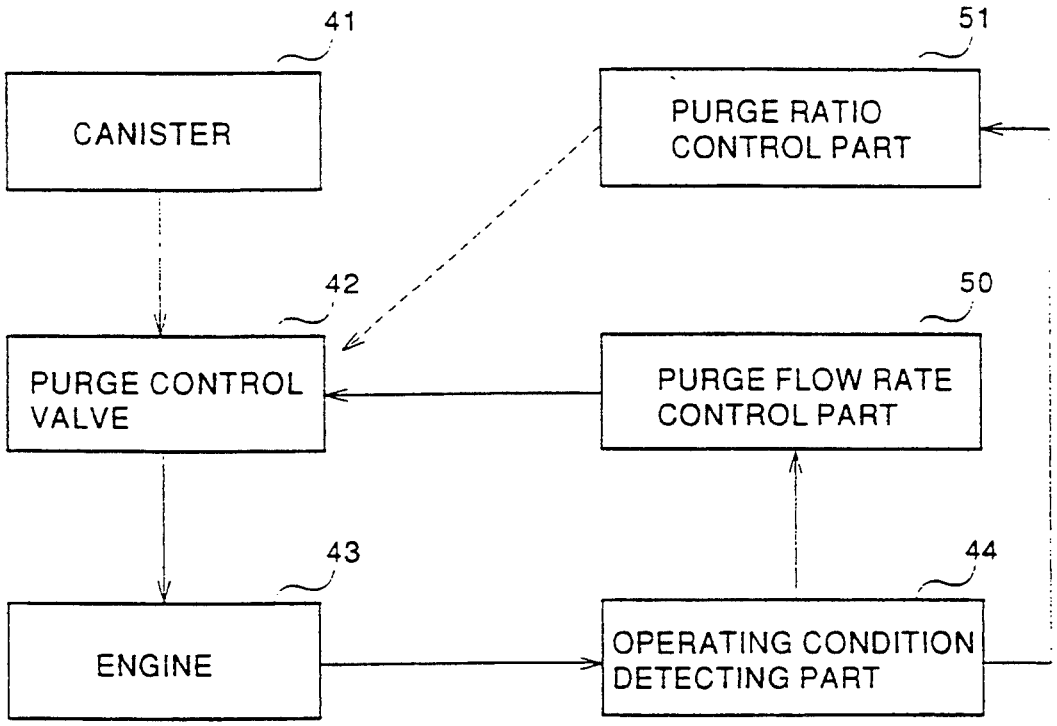
FIG. 2 is a block diagram showing a first embodiment of an evaporated fuel purge control apparatus according to the present invention.

FIG. 2 shows the first embodiment of the evaporated fuel purge control apparatus according to the present invention. In the evaporated fuel purge control apparatus shown in FIG. 2, evaporated fuel stored in a canister 41 is fed into an intake passage of an engine 43 through a purge control valve 42. The purge control valve 42 is arranged in a purge passage between the canister 41 and the intake passage. The purge passage is connected to the intake passage at a portion downstream of a throttle valve. The apparatus shown in FIG. 2 comprises the purge control valve 42 which is switched on and off in accordance with a control factor indicating a duty ratio of an on-time of the valve 42 within a duty cycle to a total duty-cycle time. The apparatus includes an operating condition detecting part 44 for detecting an operating condition under which the engine 43 is operating, and a flow rate control part 50 for setting a control factor for the purge control valve 42 to an appropriate value in accordance with the operating condition detected by the detecting part 44. The control factor set by the flow rate control part 50 allows a flow rate of evaporated fuel fed from the canister into the intake passage through the purge control valve 42 to be maintained at a constant flow rate when the engine operating condition changes. The apparatus in FIG. 2 further includes a purge ratio control part 51 coupled to the detecting part 44 for setting a control factor for the valve 42 to a value which allows a purge ratio of the evaporated fuel to be maintained at a constant purge ratio. The function of the detecting part 44 is realized by performing the step 97 in FIG. 3D by means of the ECU 20 in FIG. 1. The functions of the flow rate control part 50 and the purge ratio part 51 are realized by performing the steps 102–106 and the steps 98–101 by means of the ECU 20, respectively.

Figure 6:
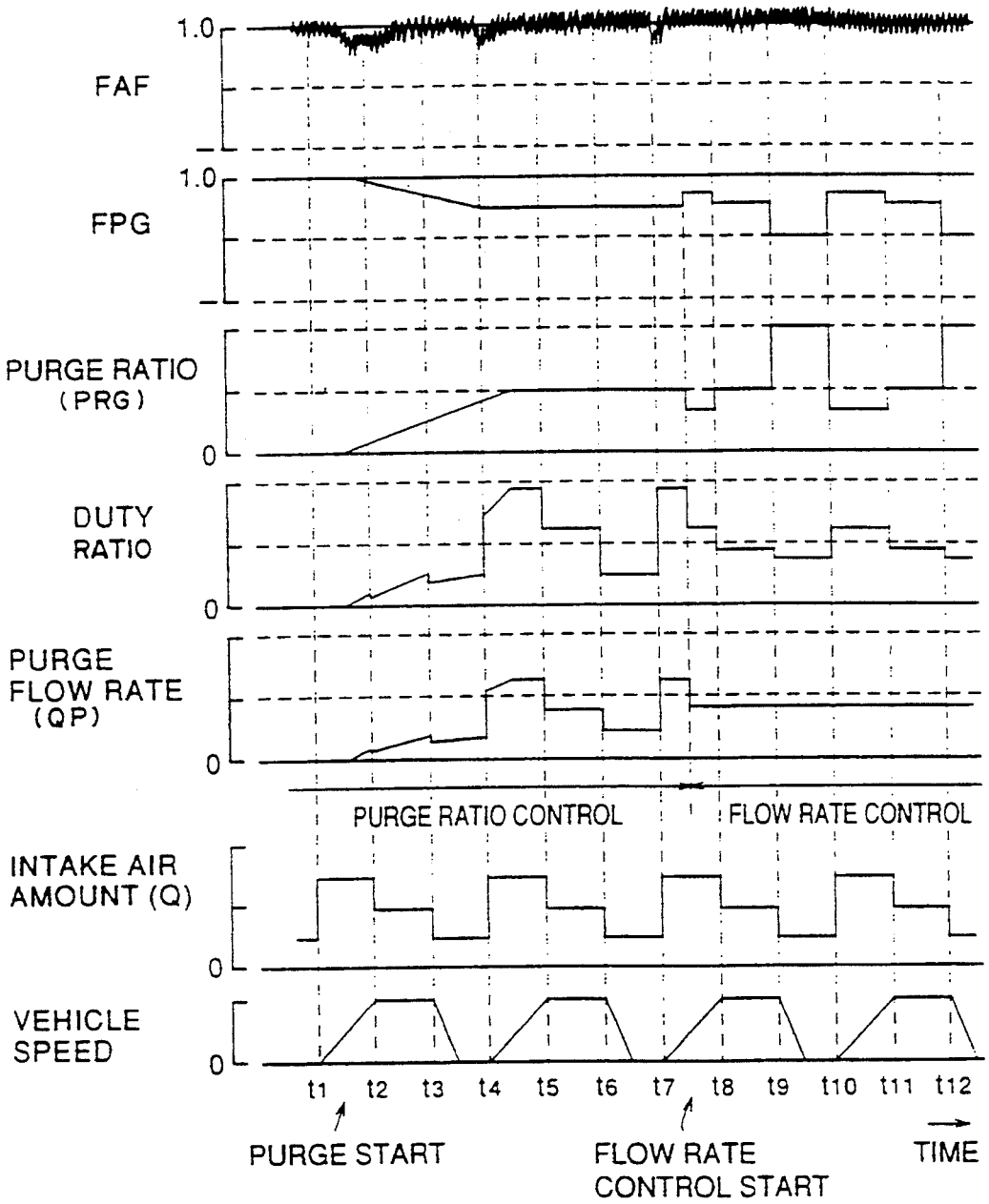
FIG. 6 is a timing chart showing changes in the intake air amount, the purge ratio and the fuel flow rate when the purge control process shown in FIGS. 3A through 3D is performed.

FIG. 6 shows changes in the intake air amount (Q), the purge ratio (PRG) and the purge flow rate (QP) when the purge control process described above is performed.

During a time period between time points t1 and t2 shown in FIG. 6, the vehicle is accelerating. When it is detected that the purge execution conditions are satisfied, the feeding of evaporated fuel from the canister into the intake passage of the engine via the VSV 17 is started. Since the purge ratio control procedure (steps 98–101 in FIG. 3D) is performed to determine the driving duty ratio PGDUTY, the purge ratio PRG is gradually increasing from zero to a target purge ratio. During a time period between time points t2 and t7 in FIG. 6, the air-fuel ratio feedback correction is performed by using the purge correction factor FPG which varies depending on the purge ratio PRG.

During a time period between time points t7 and t8 shown in FIG. 6, the vehicle is accelerating and the engine will be operating under a steady condition in which the air-fuel ratio change correctly reflects the fuel vapor concentration. Since the flow rate control execution conditions are satisfied, the flow rate control procedure (steps 102–106 in FIG. 3D) is performed during a time period between time points t8 and t12. The change in the fuel vapor concentration is thereby smaller than the previous change.

If the engine load Q/N under the accelerating condition between the time points t7 and t8 in FIG. 6 is equal to "a1" indicated in FIG. 4, the maximum purge flow rate MAXPQ is set to "b1" shown in FIG. 4. The driving duty ratio PGDUTY for the VSV 17 is set to "C/b1" so as to maintain the purge flow rate at the target purge flow rate "C". If the engine load Q/N under the steady operating condition between the time points t8 and t9 in FIG. 6 is equal to "a2" indicated in FIG. 4, the maximum purge flow rate MAXPQ is set to "b2" in FIG. 4. The driving duty ratio PGDUTY is set to "C/b2" so as to maintain the purge flow rate at the target level "C". If the engine load Q/N under the idling condition between the time points t9 and t10 in FIG. 6 is equal to "a3" indicated in FIG. 4, the maximum purge flow rate MAXPQ is set to "b3" shown in FIG. 4. The driving duty ratio PGDUTY is set to "C/b3" so as to maintain the purge flow rate at the target level "C".

Figure 7:
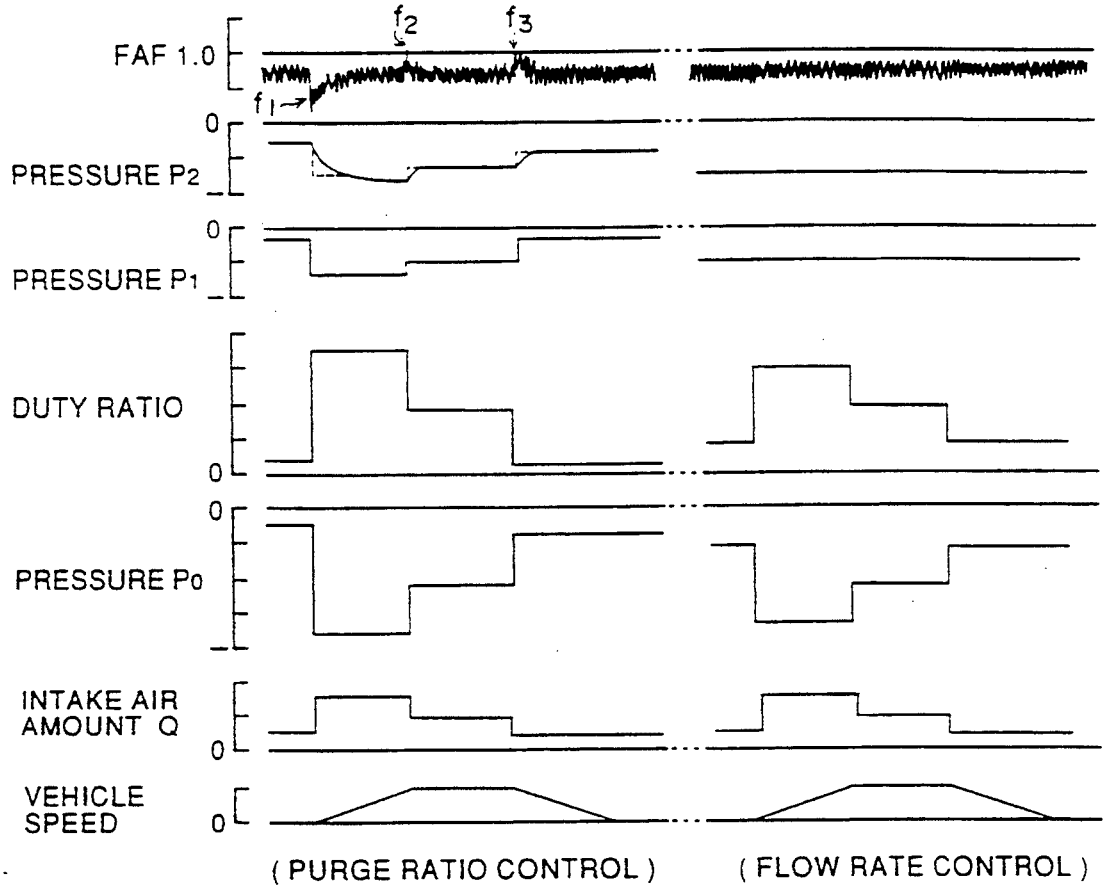
FIG. 7 is a timing chart for explaining a difference between the change in the engine operating condition when a purge ratio control process is performed and the change in the engine operating condition when the flow rate control process according to the present invention is performed.

FIG. 7 is a timing chart for explaining a difference between the FAF control when a conventional purge ratio control process is performed and the FAF control when the flow rate control process according to the present invention is performed.

The FAF control when the conventional purge ratio control process is performed is indicated in the left half of FIG. 7. As the intake air amount Q increases during vehicle acceleration, the driving duty ratio of the purge control valve is adjusted to a greater value so as to obtain a purge flow rate proportional to the intake air amount. When the duty ratio is increased, a pressure P0 in the intake passage of the engine is lowered and a pressure P1 in the canister is also lowered. A pressure P2 in the fuel tank gradually approaches the pressure P1 in the canister. For this reason, an increasing amount of fuel vapor in the fuel tank is fed from the canister into the intake passage so that the air-fuel mixture becomes rich, thus the feedback correction factor FAF becoming turbulent as indicated by "f1" in FIG. 7.

Conversely, when the intake air amount Q is decreased to change the purge flow rate to a smaller value, a certain amount of fuel vapor is fed from the canister into the fuel tank. For this reason, the purge flow rate of fuel vapor fed from the canister into the intake passage is changed to a smaller value so that the air-fuel mixture becomes lean, thus the feedback correction factor FAF becoming turbulent as indicated by "f2" and "f3" in FIG. 7. Therefore, when the conventional purge ratio control process is performed, there is a problem in that the turbulence of the air-fuel ratio is produced when the intake air flow significantly changes due to vehicle acceleration or deceleration.

The FAF control when the flow rate control process according to the present invention is performed is indicated in the right half of FIG. 7. After the fuel vapor concentration is accurately read out, the purge flow of fuel vapor fed from the canister into the intake passage is controlled such that the purge flow rate is maintained at a constant level irrespective of the change in the intake air amount due to vehicle acceleration or deceleration. The pressure P1 in the canister and the pressure P2 in the fuel tank are maintained at a constant level even if the pressure P0 in the intake passage substantially changes. Thus, the fuel vapor is fed from the canister into the intake passage at a constant flow rate, and the fuel vapor concentration converges to a constant value. As a result, the air-fuel ratio feedback control process can be stably and accurately performed, thus preventing the feedback correction factor FAF from changing to an excessive value.

In addition, if the flow rate control procedure described above is performed from the start of the engine operation, it is difficult to obtain a relatively high purge flow rate since the feedback correction factor FAF does not correctly reflect any change in the purge ratio, thus the turbulence of the feedback correction factor or the air-fuel ratio being produced. However, in the case of the evaporated fuel purge control apparatus described above, the purge ratio control procedure is selectively performed when the reading of the fuel vapor concentration per unit purge ratio is insufficient. The purge ratio is adjusted to be a constant value such that the fuel vapor amount is substantially proportional to the intake air amount. Thus, it is possible to prevent the turbulence of the air-fuel ratio. Also, it is possible to quickly read out the fuel vapor concentration since the change in the feedback correction factor FAF becomes stable, to accurately determine the purge correction factor FPG at an early stage of the air-fuel ratio feedback control process.

Figure 8:
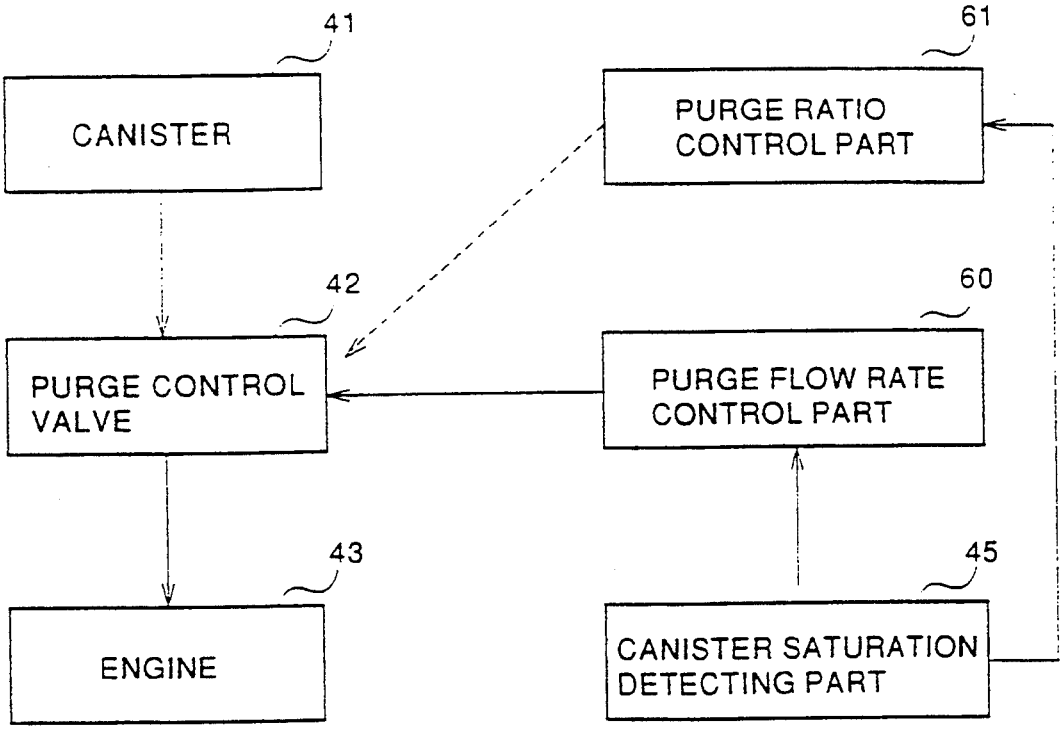
FIG. 8 is a block diagram showing a second embodiment of the evaporated fuel purge control apparatus according to the present invention.

Next, a description will be given of a second embodiment of the evaporated fuel purge control apparatus according to the present invention, with reference to FIG. 8. In the evaporated fuel purge control apparatus shown in FIG. 8, evaporated fuel stored in the canister 41 is fed into the intake passage of the engine 43 through the purge control valve 42. The evaporated fuel purge control apparatus shown in FIG. 8 comprises the purge control valve 42 which is switched on and off in accordance with a control factor indicating a duty ratio of an on-time of the valve 42 within a duty cycle to a total duty-cycle time. The apparatus includes a canister saturation detecting part 45 for detecting whether or not the canister 41 is saturated with fuel vapor, and a flow rate control part 60 for setting a control factor for the purge control valve 42 to a value which allows a flow rate of evaporated fuel from the canister 41 to the intake passage through the purge control valve 42 to be maintained at a constant flow rate when the canister 41 is saturated with fuel vapor. The apparatus further includes a purge ratio control part 61 coupled to the detecting part 45 for setting a control factor for the valve 42 to a value which allows a purge ratio of the evaporated fuel to be maintained at a constant purge ratio when the canister 41 is not saturated with fuel vapor.

Figure 9:
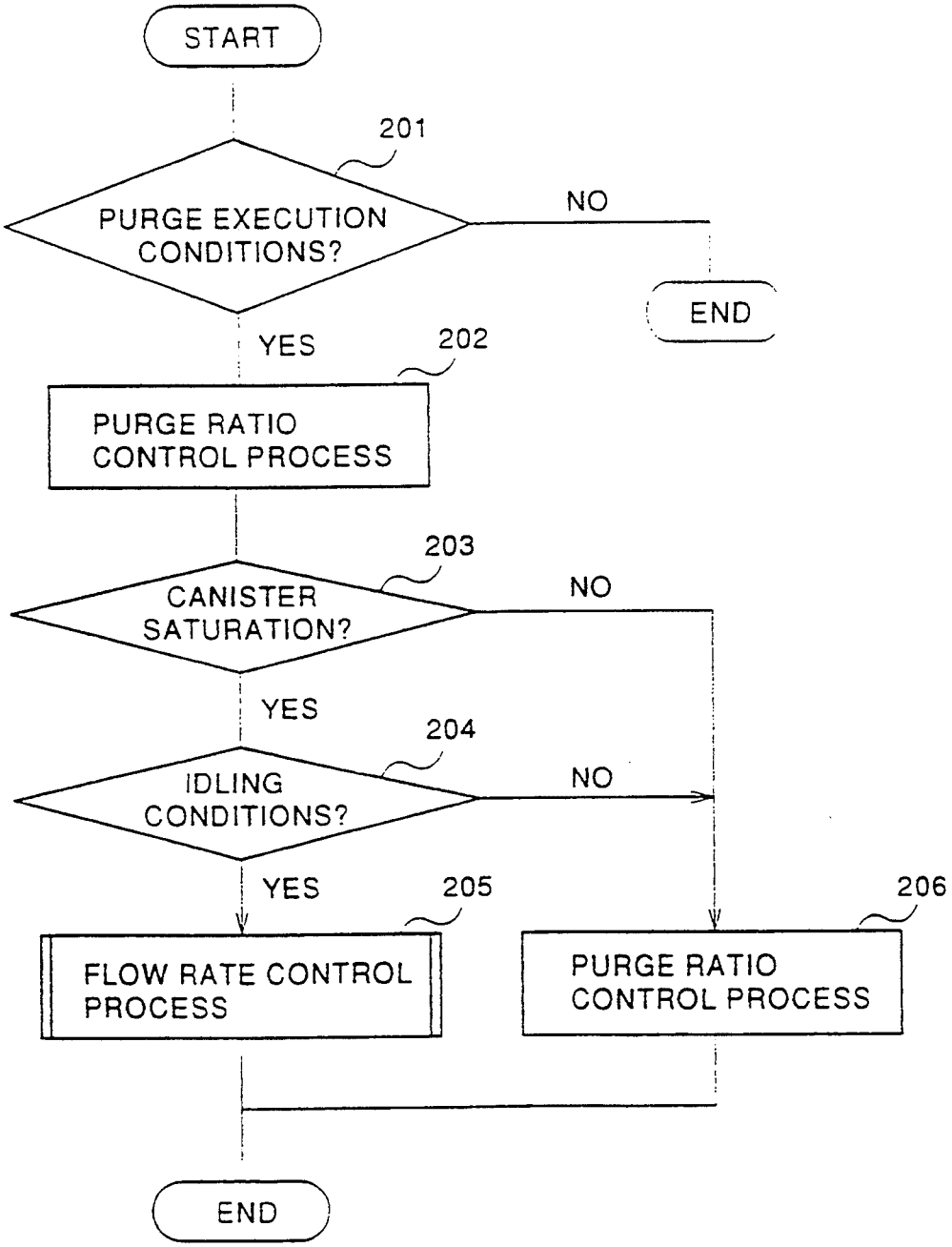
FIG. 9 is a flowchart for explaining a purge control process performed by the evaporated fuel purge control apparatus shown in FIG. 8.

FIG. 9 shows a purge control process which is performed by the second embodiment of the evaporated fuel purge control apparatus according to the present invention. The purge control process is also repeatedly performed by the ECU 20 in FIG. 1 at given time intervals.

In the purge control process shown in FIG. 9, step 201 detects whether or not the purge execution conditions (which are the same as the above conditions detected in step 74 in FIG. 3B) are satisfied. If the answer to step 201 is negative, the purge control process ends. If the answer to step 201 is affirmative, step 202 is performed.

In step 202 shown in FIG. 9, a purge ratio control process (which is essentially the same as the purge ratio control procedure of steps 98–101 in FIG. 3D) is carried out such that the purge flow rate is proportional to the intake air amount. Generally, the purge ratio is determined to be the purge flow rate divided by the intake air amount. Thus, when the purge ratio control process is performed, the purge ratio is maintained at a constant level by setting the driving duty ratio of the VSV 17. In accordance with the amount of fuel injected by the fuel injection valve 4, the intake air amount sensed by the air flow meter 7 and the air-fuel ratio sensed by the oxygen sensor 31, the ECU 20 sets the driving duty ratio of the VSV 17 so as to allow the purge ratio to be maintained at a constant level. The ECU 20 is capable of calculating the concentration of fuel vapor fed from the canister into the intake passage of the engine through the VSV 17.

When the canister 11 is saturated with fuel vapor, the concentration of fuel vapor supplied from the canister 11 is higher than a threshold value. This threshold value is predetermined in accordance with the capacity of the active carbon 10 of the canister 11 to store a limited amount of fuel vapor. Step 203 detects whether or not the active carbon 10 of the canister 11 is saturated with fuel vapor by comparing the fuel vapor concentration with the threshold value.

Generally, a flow resistance of the canister 11 when the canister 11 is saturated with fuel vapor is still higher than a flow resistance when the canister 11 is not saturated with fuel vapor. When the engine is operating under an idling condition in which the intake air amount is very small and the driving duty ratio of the VSV 17 is set at a relatively small value, it is difficult to obtain an adequate level for the purge flow rate in accordance with the driving duty ratio of the VSV 17. In the second embodiment of the present invention, the driving duty ratio of the VSV 17 is set at a value greater than a given threshold value when the engine is operating under an idling condition, so as to obtain an adequate level for the purge flow rate.

If the answer to step 203 is affirmative (the canister 11 is saturated), step 204 detects whether or not the engine is operating under an idling condition by checking a signal output from the throttle switch 28. If the answer to step 204 is affirmative (the engine is operating under an idling condition), step 205 is performed, and then the purge control process ends.

In step 205 shown in FIG. 9, a flow rate control process (which is essentially the same as the flow rate control procedure of steps 102–106 in FIG. 3D) is carried out such that an adequate level of the purge flow rate will be obtained. When the flow rate control process mentioned above is performed, the purge flow rate is maintained at a constant, relatively high level by setting the driving duty ratio of the VSV 17. The details of the flow rate control process will be described below.

If the answer to step 203 or step 204 is negative, step 206 is performed. In step 206, the above described purge ratio control process is continuously performed. After step 206 is performed, the purge control process ends.

Figure 10A:
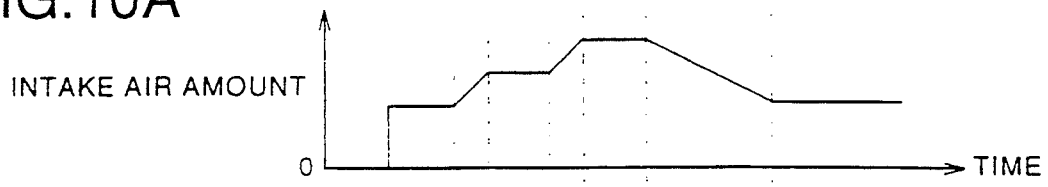
FIGS. 10A through 10C are timing charts showing changes in the intake air amount, the purge ratio and the fuel flow rate when a flow rate control process is performed.
Figure 10B:
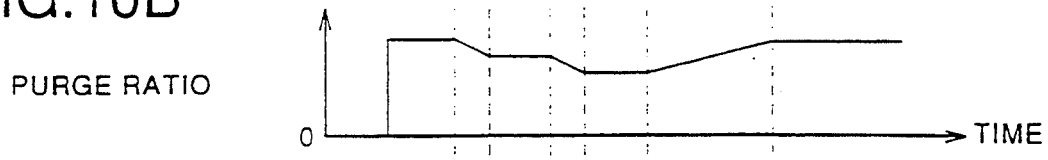
Figure 10C:
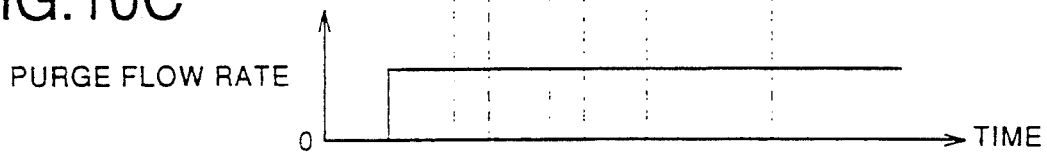

FIGS. 10A through 10C show changes in the intake air amount, the purge ratio and the purge flow rate when the flow rate control process is performed. As described above, when the flow rate control process is being performed, the purge flow rate of fuel vapor fed from the canister 11 into the intake passage through the VSV 17 is maintained at a constant value as shown in FIG. 10C. As shown in FIGS. 10A and 10B, if the intake air amount is increased, the purge ratio is decreased due to the purge flow rate being maintained at a constant value. Conversely, if the intake air amount is decreased, the purge ratio is increased due to the purge flow rate being maintained at a constant value.

Figure 11A:
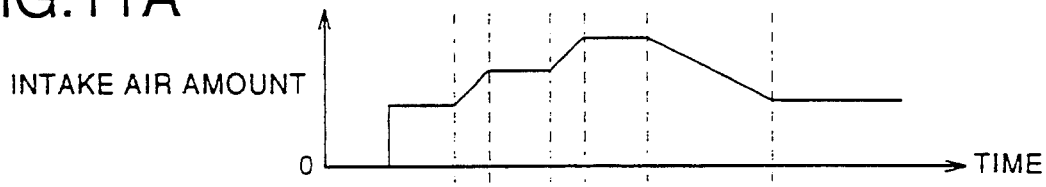
FIGS. 11A through 11C are timing charts showing changes in the intake air amount, the purge ratio and the fuel flow rate when a purge ratio control process is performed.
Figure 11B:
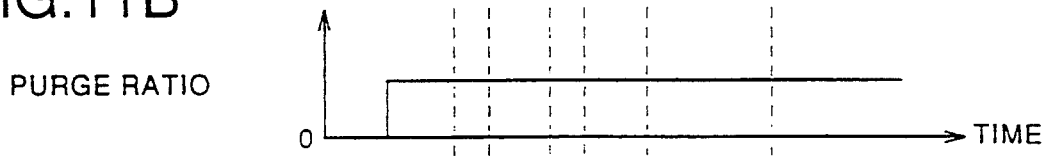
Figure 11C:
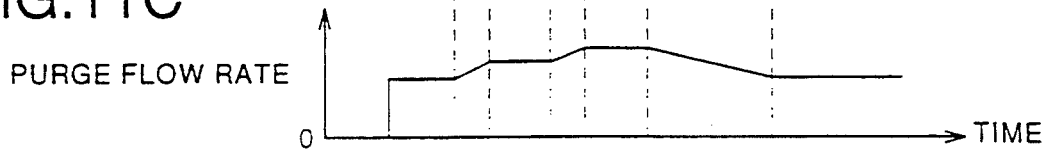

FIGS. 11A through 11C show changes in the intake air amount, the purge ratio and the purge flow rate when the purge ratio control process is performed. When the purge ratio control process is being performed, the purge ratio is maintained at a constant value as shown in FIG. 11B. As shown in FIGS. 11A and 11C, if the intake air amount is increased, the purge flow rate of fuel vapor fed from the canister 11 into the intake passage through the VSV 17 is also increased. Conversely, if the intake air amount is decreased, the purge flow rate is also decreased. In other words, the purge flow rate varies in accordance with the change in the intake air amount when the purge ratio control process is performed.

Both the flow rate control process and the purge ratio control process are carried out by setting the driving duty ratio of the VSV 17 to an appropriate value. The driving duty ratio of the VSV 17 indicates a duty ratio of an on-time of the VSV 17 within a duty cycle to a total duty-cycle time. The driving duty ratio is basically determined in accordance with the equation: the driving duty ratio=(target purge ratio)/(maximum purge ratio), where the maximum purge ratio is a ratio of the purge flow rate when the VSV 17 is fully opened (switched on for a total duty-cycle time) to the intake air amount. The maximum purge ratio is a function of the engine load and the engine speed, and each value of the maximum purge ratio is predetermined and stored as a map in the ROM 22.

In order to control the driving duty ratio of the VSV 17, it is necessary to determine the purge ratio. When the flow rate control process is being performed, the purge ratio varies in accordance with the change in the intake air amount. Thus, the flow rate control process requires additional steps to the steps required by the purge ratio control process.

In the second embodiment of the evaporated fuel purge control apparatus according to the present invention, the flow rate control process is performed only when the canister 11 is saturated with fuel vapor and the engine is operating under an idling condition. When the engine is operating under an operating condition other than the idling condition, the purge ratio control process is performed.

The function of the canister saturation detecting part 45 of the second embodiment is realized by performing the above step 203 in FIG. 9 by means of the ECU 20 shown in FIG. 1. The function of the purge flow rate control part 60 of the second embodiment is realized by performing the above step 205 in FIG. 9 by means of the ECU 20.

Figure 12A:
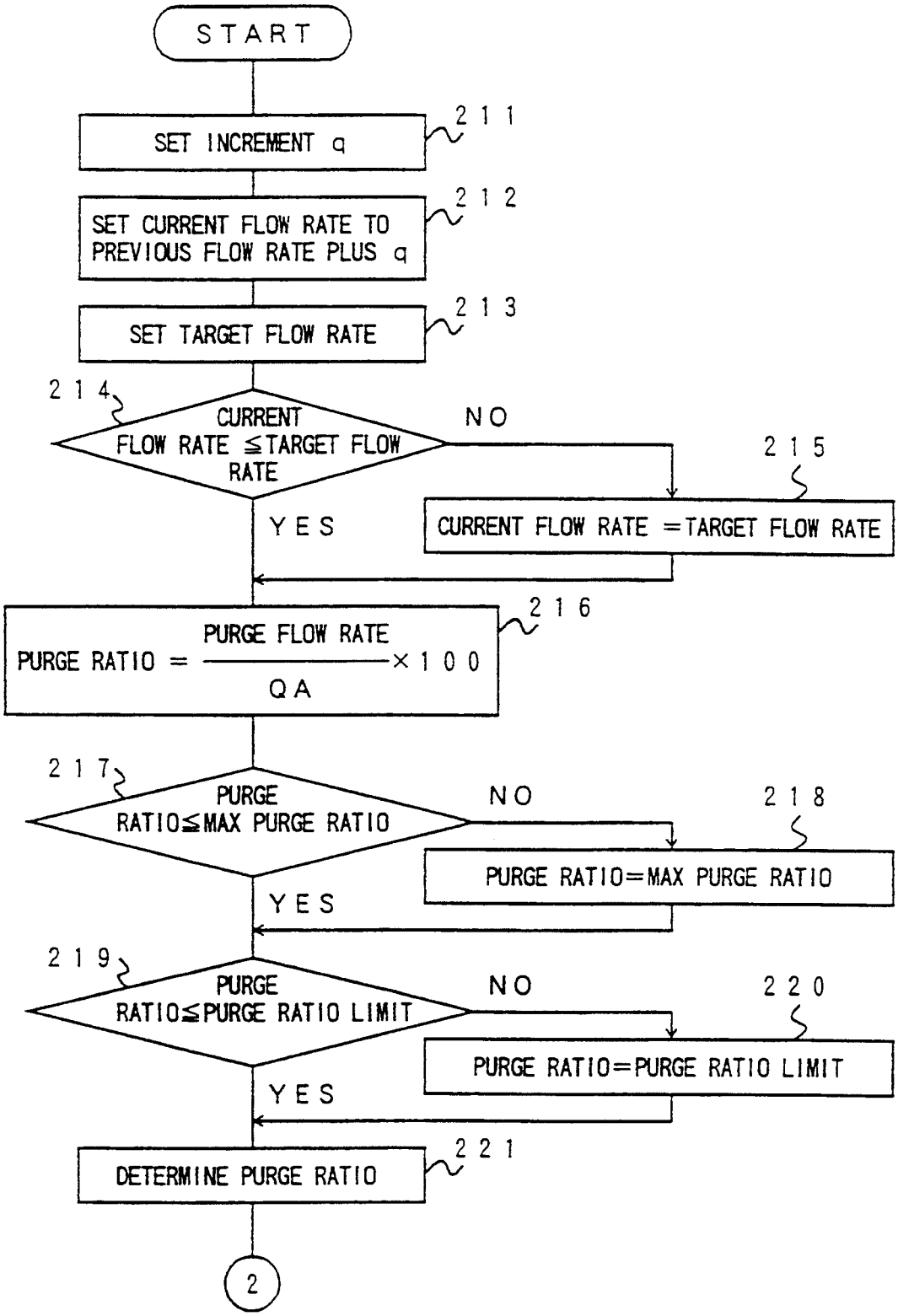
FIGS. 12A and 12B are a flowchart for explaining a flow rate control process performed by the second embodiment of the evaporated fuel purge control apparatus shown in FIG. 8.
Figure 12B:
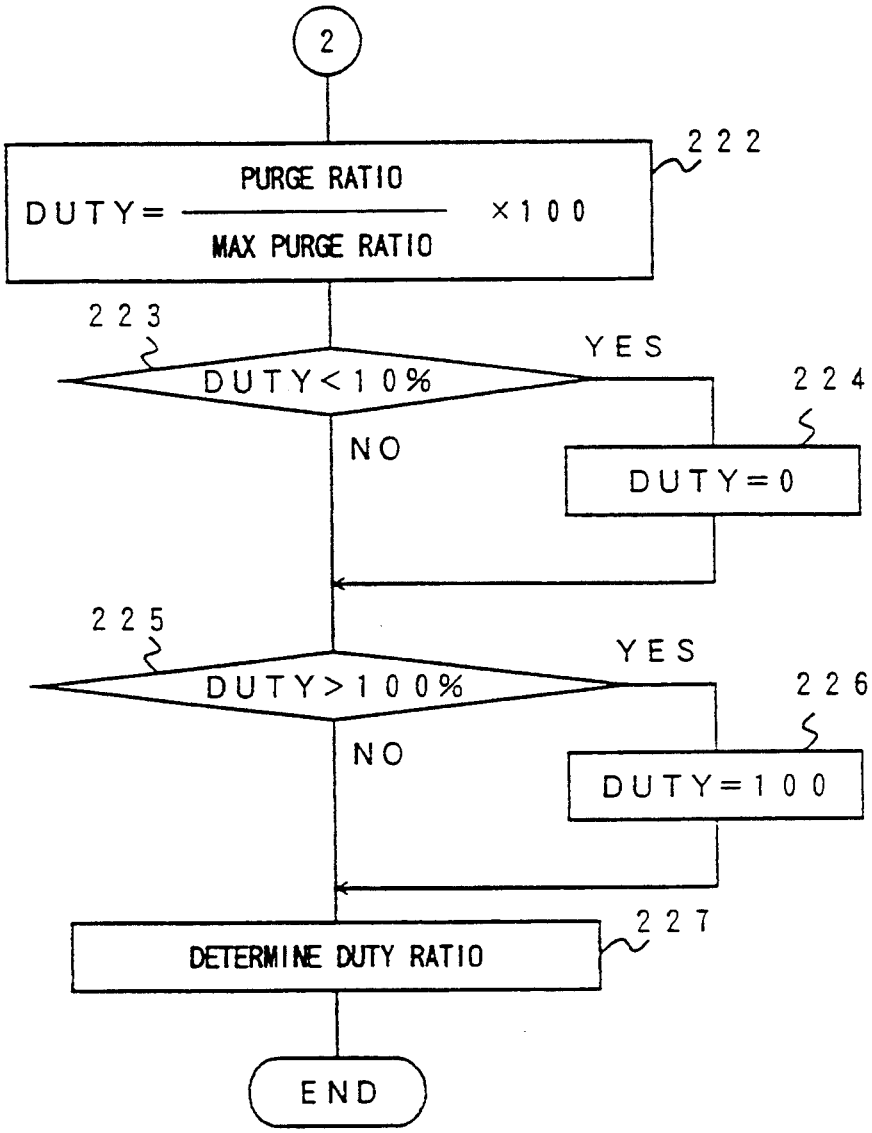

FIGS. 12A and 12B show in detail the flow rate control process (corresponding to the above step 205 in FIG. 9) which is performed by the second embodiment of the evaporated fuel purge control apparatus.

When it is detected that the canister is saturated with fuel vapor and that the engine is operating under an idling condition, the flow rate control process shown in FIGS. 12A and 12B is performed. In this flow rate control process, step 211 sets an increment "q" which will be added to a previously set purge flow rate to set a current purge flow rate.

As described above, the engine is operating under an idling condition, and the intake air amount is relatively small. The purge flow rate when the flow rate control process has just started is still not at an adequate level. Therefore, when the flow rate control process has just started, it is necessary to gradually increase the purge flow rate to a given value. However, the canister 11 is saturated with fuel vapor at this time. If the purge flow rate is rapidly increased, the fuel vapor at an excessively high concentration will be supplied to the intake passage of the engine, making the air-fuel ratio feedback control process inoperative.

Therefore, it is necessary to gradually increase the purge flow rate to a given value. The increment "q" set in step 211 is determined by the ECU 20 so as to enable the purge flow rate to be efficiently increased to a given value while the air-fuel ration feedback control process is performed based on the fuel injection amount.

After step 211 is performed, step 212 sets a current purge flow rate by adding the increment "q" to the previously-set purge flow rate. Step 213 sets a target purge flow rate, and the target purge flow rate is a given value which will allow an adequate level of the purge flow rate to be obtained from the canister 11 in the saturated condition.

After step 213 is performed, step 214 detects whether or not the current purge flow rate is smaller than or equal to the target purge flow rate. If the answer to step 214 is negative, step 215 is performed. If the answer to step 214 is affirmative, step 216 is performed.

Initially, the purge flow rate is not greater than the target purge flow rate, and then step 216 is performed. After the flow rate control process has been repeatedly performed, the purge flow rate is increased stepwise to a value greater than the target flow rate. Step 215 sets the current purge flow rate to be equal to the target purge flow rate, to avoid making the air-fuel mixture excessively rich.

Step 216 calculates a purge ratio at present from the purge flow rate obtained in step 212 or 215 and from the intake air amount QA at present in accordance with the equation: the purge ratio=[(purge flow rate)/QA]×100%. The purge ratio calculated in step 216 will be used to set a driving duty ratio of the VSV 17. After step 216 is performed, step 217 detects whether or not the purge ratio is smaller than or equal to the maximum purge ratio.

There is a possibility that the purge ratio calculated in step 216 is greater than the maximum purge ratio which is a ratio of the purge flow rate when the VSV 17 is fully opened to the intake air amount. If the answer to step 217 is negative (the purge ratio being greater than the maximum purge ratio), step 218 is performed. Step 218 sets the calculated purge ratio to be equal to the maximum purge ratio.

In addition, there is a possibility that the purge ratio calculated in step 216 is greater than a purge ratio limit that is an upper limit of the purge ratio which permits the air-fuel mixture supplied to the engine to fall within an appropriate range through a correction to the fuel ignition time TAU at the fuel injection valve 4. If the purge ratio is greater than the purge ratio limit, the air-fuel mixture supplied to the engine will be rich even when no fuel is injected by the fuel injection valve 4 into the engine.

To avoid the above mentioned problem, step 219 detects whether or not the purge ratio calculated in step 216 is smaller than or equal to the purge ratio limit mentioned above. If the answer to step 219 is negative, step 220 is performed. Step 220 sets the purge ratio to be equal to the purge ratio limit.

After steps 211–220 shown in FIG. 12A are performed, the calculation of the purge ratio at present is completed. Step 221 determines the value of the purge ratio at present which will be used to set the driving duty ratio of the VSV 17 to an appropriate value. After step 221 is performed, steps 222–227 shown in FIG. 12B are performed to determine an appropriate value of the driving duty ratio of the VSV 17.

In step 222 shown in FIG. 12B, the driving duty ratio DUTY of the VSV 17 is calculated from the maximum purge ratio and the purge ratio obtained in step 221 in accordance with the equation: DUTY=[(purge ratio)/(maximum purge ratio)]×100%. In order to obtain a desired level of the purge fuel flow, the VSV 17 is switched on and off by the ECU 20 in accordance with the driving duty ratio DUTY.

After step 222 is performed, step 223 detects the driving duty ratio DUTY calculated in step 222 is smaller than 10%. If the VSV 17 is switched on and off by using a value of the driving duty ratio smaller than 10%, it is difficult to obtain the intended level of the purge flow rate proportional to the value of the driving duty ratio since the on-time of the VSV 17 within a duty cycle is small. In the evaporated fuel purge control apparatus shown in FIG. 8 at this time, the VSV 17 is fully closed by setting the driving duty ratio DUTY to 0%. If the answer to step 223 is affirmative, step 224 sets the driving duty ratio DUTY to zero. If the answer to step 223 is negative, step 225 is performed without performing step 224.

Step 225 detects whether or not the driving duty ratio calculated in step 222 is greater than 100%. If the answer to step 225 is affirmative, step 226 sets the driving duty ratio DUTY to 100% so as to allow the actual switching control of the VSV 17. If the answer to step 225 is negative, step 227 is performed without performing step 226.

After steps 222–226 shown in FIG. 12B are performed, the calculation of the driving duty ratio of the VSV 17 is completed. Step 227 determines the value of the driving duty ratio DUTY at present. Then, the flow rate control process ends. The flow rate control process described above will be repeated to update the purge ratio and the driving duty ratio at each process execution until the actual purge ratio reaches the target purge ratio so as to allow the canister 11 to be in an unsaturated condition.

If step 203, shown in FIG. 9, detects that the canister 11 is no longer saturated with fuel vapor, the purge ratio control process is performed in step 206 of the purge control process shown in FIG. 9. This purge ratio control process is carried out in a manner similar to that of steps 222–227 shown in FIG. 12B. The purge ratio in step 222 is substituted by a predetermined target purge ratio, and the maximum purge ratio in step 222 is substituted by a predetermined value of the maximum purge ratio derived from the map stored in the ROM 22 in response to the operating condition of the engine at present. The driving duty ratio DUTY is thus determined in accordance with the equation: DUTY=[(purge ratio)/(maximum purge ratio)]×100%.

As described above, in the second embodiment of the evaporated fuel purge control apparatus, an adequate level for the purge flow rate can be produced when the canister 11 is saturated with fuel vapor and the engine operating condition is an idling condition. The purge control process according to the present invention is not significantly influenced by the flow resistance of the canister 11 in the saturated state. The turbulence of the air-fuel ratio due to the variation of the purge flow rate, as in the conventional apparatus, can be eliminated, thus allowing the air-fuel ratio feedback control process to be efficiently and reliably performed.

In the above described second embodiment, the detecting part 45 for detecting whether or not the canister is saturated with fuel vapor is realized by means of the ECU 20. The ECU 20 calculates the concentration of fuel vapor fed from the canister into the intake passage through the VSV 17, and compares the fuel vapor concentration with the threshold value, thus detecting whether the canister is saturated fuel vapor or not. However, the present invention is not limited to this embodiment. It is possible that the detecting part 45 be realized by a sensor mounted on the canister 11 for detecting a fuel vapor saturation condition of the canister 11.

Further, the present invention is not limited to the above described embodiments, and variations and modifications may be made without departing from the scope of the present invention.

What is claimed is:

1. An apparatus for controlling a flow of evaporated fuel fed from a canister into an intake passage of an engine through a purge control valve, said apparatus comprising:

a purge control valve arranged in a purge passage between the canister and the intake passage, said purge control valve switchable between on and off positions in accordance with a duty ratio control factor, said duty ratio control factor indicating a duty ratio of an on-time of said purge control valve within a duty cycle to a total duty-cycle time;

detecting means for detecting an operating condition under which the engine is operating; and flow rate control means for setting a purge flow rate control factor for said purge control valve in accordance with the engine operating condition detected by said detecting means, said purge flow rate control factor set by said flow rate control means allowing a flow rate of evaporated fuel from the canister into the intake passage through the purge control valve to be maintained at a constant level when the engine operating condition changes;

wherein said flow rate control means sets a purge flow rate correction control factor for the purge control valve when said detecting means detects that a fuel vapor concentration factor is smaller than a given value and that a fuel vapor concentration setting count is greater than a given number.

2. An apparatus for controlling a flow of evaporated fuel fed from a canister into an intake passage of an engine through a purge control valve, said apparatus comprising:

a purge control valve arranged in a purge passage between the canister and the intake passage, said purge control valve switchable between on and off positions in accordance with a duty ratio control factor, said duty ratio control factor indicating a duty ratio of an on-time of said purge control valve within a duty cycle to a total duty-cycle time;

detecting means for detecting an operating condition under which the engine is operating; and flow rate control means for setting a purge flow rate control factor for said purge control valve in accordance with the engine operating condition detected by said detecting means, said purge flow rate control factor set by said flow rate control means allowing a flow rate of evaporated fuel from the canister into the intake passage through the purge control valve to be maintained at a constant level when the engine operating condition changes;

wherein said flow rate control means sets a purge flow rate correction control factor based on a maximum purge flow rate and a target purge flow rate in accordance with the engine operating condition detected by said detecting means, said maximum purge flow rate being predetermined as a function of an engine load and retrieved from a map stored in a memory, and said target purge flow rate being increased in accordance with a fuel vapor concentration setting count.

3. An apparatus for controlling a flow of evaporated fuel fed from a canister into an intake passage of an engine through a purge control valve, said apparatus comprising:

a purge control valve arranged in a purge passage between the canister and the intake passage, said purge control valve switchable between on and off positions in accordance with a duty ratio control factor, said duty ratio control factor indicating a duty ratio of an on-time of said purge control valve within a duty cycle to a total duty-cycle time;

detecting means for detecting an operating condition under which the engine is operating; and flow rate control means for setting a purge flow rate control factor for said purge control valve in accordance with the engine operating condition detected by said detecting means, said purge flow rate control factor set by said flow rate control means allowing a flow rate of evaporated fuel from the canister into the intake passage through the purge control valve to be maintained at a constant level when the engine operating condition changes; and purge ratio control means coupled to said detecting means for setting a purge ratio control factor for said purge control valve when said detecting means detects that a fuel vapor concentration factor is not smaller than a given value or when said detecting means detects that a fuel vapor concentration setting count is not greater than a given number, said purge ratio control factor set by said purge ratio control means allowing a purge ratio of evaporated fuel from the canister into the intake passage through the purge control valve to be maintained at a constant level.

4. An apparatus according to claim 3, wherein said purge ratio control means sets said purge ratio control factor based on a maximum purge ratio and a target purge ratio in accordance with the engine operating condition detected by said detecting means, said maximum purge ratio being determined as the ratio of a maximum purge flow rate to an intake air amount.

5. An apparatus for controlling a flow of evaporated fuel being fed from a canister into an intake passage of an engine through a purge control valve, said apparatus comprising:

a purge control valve arranged in a purge passage between the canister and the intake passage, said purge control valve being switched on and off in accordance with a control factor, said control factor indicating a duty ratio of an on-time of said purge control valve within a duty cycle to a total duty-cycle time;

detecting means for detecting whether or not the canister is saturated with fuel vapor; and flow rate control means for setting a control factor for said purge control valve when said detecting means detects that the canister is saturated with fuel vapor, said control factor set by said flow rate control means allowing a flow rate of evaporated fuel fed from the canister into the intake passage through the purge control valve to be maintained at a constant level when the canister is saturated with fuel vapor.

6. An apparatus according to claim 5, wherein said flow rate control means sets a control factor based on a target purge flow rate and a maximum purge ratio in accordance with an operating condition of the engine, said maximum purge ratio being predetermined as a function of an engine load and retrieved from a map stored in a memory.

7. An apparatus according to claim 5, further comprising purge ratio control means for setting a control factor for said purge control valve when it is detected that the canister is not saturated with fuel vapor, said control factor set by said purge ratio control means allowing a purge ratio of evaporated fuel fed from the canister into the intake passage through the purge control valve to be maintained at a constant level when the canister is not saturated with fuel vapor.

8. An apparatus according to claim 7, further comprising means for detecting whether or not the engine is operating under an idling condition, said purge ratio control means being allowed to set a control factor for the purge control valve when said means detects that the engine is not operating under an idling condition.

9. An apparatus according to claim 5, further comprising means for detecting whether or not the engine is operating under an idling condition, said purge ratio control means being allowed to set a control factor for the purge control valve when said means detects that the engine is not operating under an idling condition.

* * * * *